US007644700B2

(12) United States Patent
Rossignol et al.

(10) Patent No.: US 7,644,700 B2
(45) Date of Patent: Jan. 12, 2010

(54) FUEL INJECTION SYSTEM FOR AN INTERNAL COMBUSTION ENGINE

(75) Inventors: Francois Rossignol, Mornant (FR); Olivier Charvet, Saint Laurent de Mure (FR)

(73) Assignee: Robert Bosch GmbH, Stuttgart (DE)

( * ) Notice: Subject to any disclaimer, the term of this patent is extended or adjusted under 35 U.S.C. 154(b) by 413 days.

(21) Appl. No.: 11/721,233

(22) PCT Filed: Nov. 22, 2005

(86) PCT No.: PCT/EP2005/056149

§ 371 (c)(1),
(2), (4) Date: Jun. 8, 2007

(87) PCT Pub. No.: WO2006/067016

PCT Pub. Date: Jun. 29, 2006

(65) Prior Publication Data

US 2009/0229577 A1 Sep. 17, 2009

(30) Foreign Application Priority Data

Dec. 22, 2004 (DE) ..... 10 2004 061 799

(51) Int. Cl.
*B05B 15/06* (2006.01)
*F02M 59/20* (2006.01)
*F02M 59/48* (2006.01)

(52) U.S. Cl. ..... 123/458; 123/459; 123/469; 123/476; 239/600

(58) Field of Classification Search ..... 123/458, 123/459, 469, 472, 476, 511; 239/585.1, 239/600

See application file for complete search history.

(56) References Cited

U.S. PATENT DOCUMENTS

| | | | | |
|---|---|---|---|---|
| 5,009,390 | A * | 4/1991 | McAuliffe et al. | 251/129.2 |
| 5,676,114 | A | 10/1997 | Tarr et al. | |
| 5,819,704 | A | 10/1998 | Tarr et al. | |
| 6,098,903 | A | 8/2000 | Touvelle et al. | |
| 6,102,303 | A | 8/2000 | Bright et al. | |
| 6,109,543 | A | 8/2000 | Bright et al. | |
| 6,299,079 | B1 * | 10/2001 | Noller et al. | 239/600 |
| 7,273,037 | B2 * | 9/2007 | Kondo | 123/456 |
| 2002/0084340 | A1 * | 7/2002 | Dallmeyer et al. | 239/5 |
| 2002/0170537 | A1 | 11/2002 | Reusing | |
| 2004/0124252 | A1 | 7/2004 | Luedicke | |
| 2006/0071102 | A1 * | 4/2006 | Dallmeyer | 239/585.1 |
| 2006/0076439 | A1 * | 4/2006 | Stier | 239/585.1 |

FOREIGN PATENT DOCUMENTS

| | | | |
|---|---|---|---|
| DE | 19732447 | A1 | 2/1998 |
| DE | 10123994 | A1 | 11/2002 |

* cited by examiner

*Primary Examiner*—Erick Solis
(74) *Attorney, Agent, or Firm*—Ronald E. Greigg

(57) ABSTRACT

The fuel injection system has at least two electrically actuated control valves for controlling the fuel injection; the control valves are each connected via electric lines to an electric control unit. In the fuel injection system, terminal elements for connection of the electric lines are provided. For a first of the control valves, a structural element is provided, on which the terminal elements for all the control valves are disposed, and which can be secured to a housing part of the fuel injection system. At least one electric connecting line from the terminal elements to the second control valve disposed inside a housing part of the fuel injection system is integrated with the structural element.

20 Claims, 3 Drawing Sheets

III
24
26
16
19
62
68
67
56
66
57
82
20
10
18
65
22
54
79
74
77
60
II
76
78
72
52
73
59
75
51
36
48
30
32
34
46
12
40
38
42
41
44
35
54
49
50
58
54
55
90
92
64
63
29
28

FUEL INJECTION SYSTEM FOR AN INTERNAL COMBUSTION ENGINE

CROSS-REFERENCE TO RELATED APPLICATION

This application is a 35 USC 371 application of PCT/EP 2005/056149 on Nov. 22, 2005.

BACKGROUND OF THE INVENTION

1. Field of the Invention

The invention is directed to an improved fuel injection system for an internal combustion engine.

2. Description of the Prior Art

One fuel injection system is known from German Patent Disclosure DE 101 23 994 A1 has two electrically actuated control valves for controlling the fuel injection. The two control valves are each connected to an electric control unit via electric lines. The electrical contacting of the two control valves is complicated; typically, a separate terminal for each control valve must be present, with which a respective terminal element, for instance a plug element, must be joined together. This makes for complicated production and assembly of the fuel injection system, with many individual parts. Moreover, under some circumstances, the installation space required for the fuel injection system is greater, and enough free space in the surroundings of the fuel injection system in the engine must be provided, to enable attaching and detaching the plug elements. An electrical connection beginning at a common electrical terminal for both control valves and extending inside the fuel injection system could also be provided, but once again that would lead to increased production effort and expense, and in terms of its accommodation within the fuel injection system and the requisite sealing off from the fuel, this would be problematic.

SUMMARY AND ADVANTAGES OF THE INVENTION

The fuel injection system according to the invention has the advantage over the prior art that the electrical terminals of the two control valves are disposed on a single structural element, so that only at a single point in the fuel injection system is enough free space required for mounting and detaching one or more terminal elements. Because of the integration of the at least one connecting line to the second control valve with the structural element, it is moreover unnecessary to lay electric lines inside the fuel injection system.

Advantageous embodiments and refinements of the fuel injection system of the invention are disclosed. In one embodiment, the structural element is jointly used for the construction of the first control valve, so that no further components, or only a few further components, are needed for the purpose. Another embodiment makes it possible to compensate for tolerances and thermal expansions and thus makes a durable, secure contacting of the second control valve possible. A further embodiment makes simple contacting of the second control valve possible.

BRIEF DESCRIPTION OF THE DRAWINGS

The invention is more fully described herein below, with reference to the drawings, in which.

DESCRIPTION OF THE PREFERRED EMBODIMENTS

Figure 1:
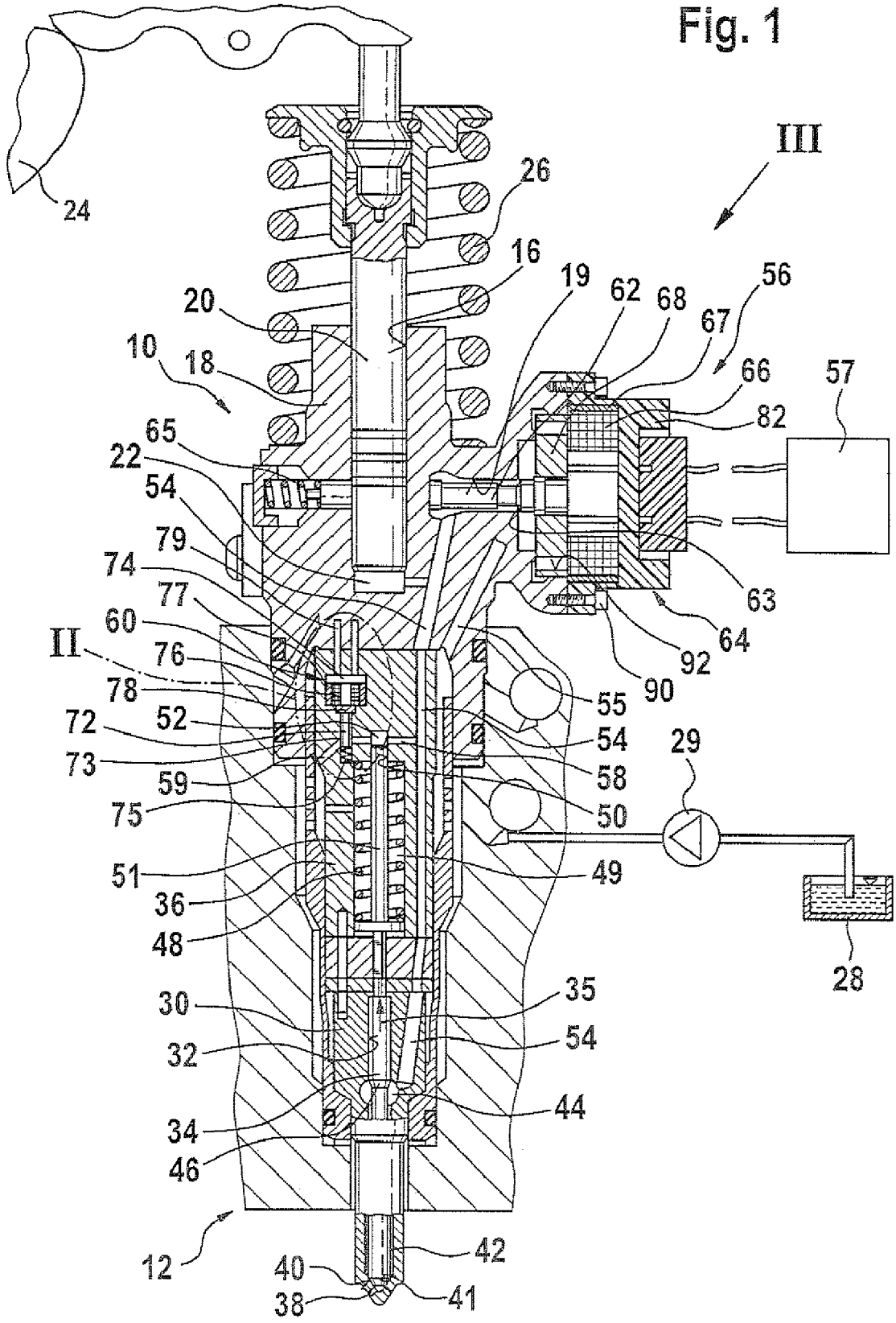
FIG. 1 schematically shows a fuel injection system for an internal combustion engine in a longitudinal section, with two control valves.
Figure 2:
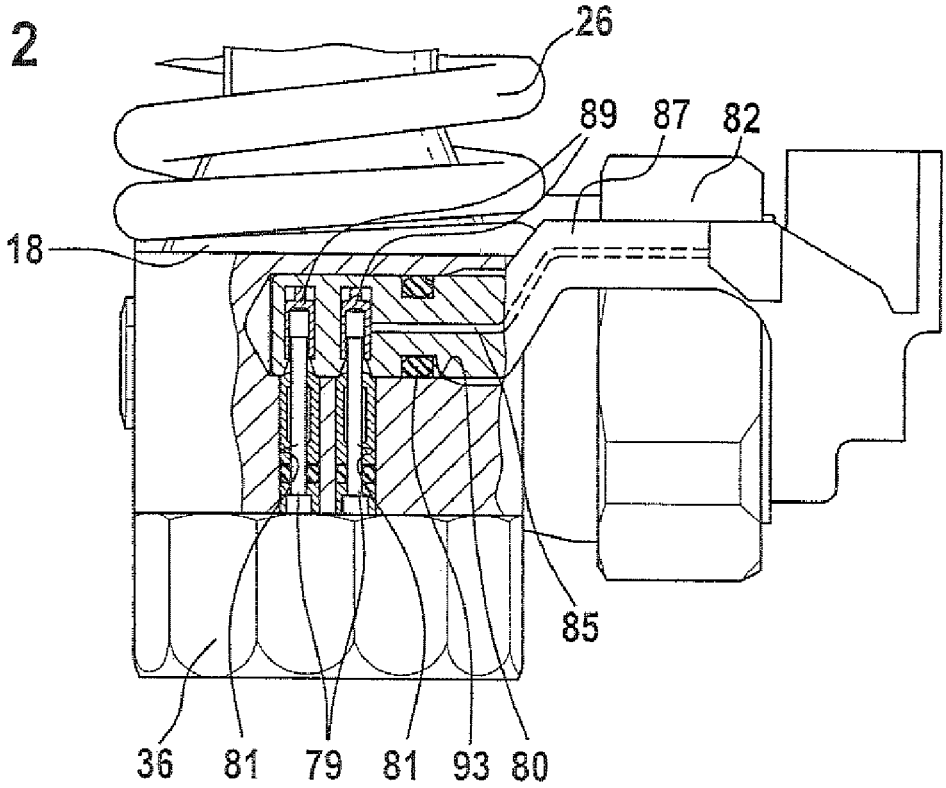
FIG. 2 shows a detail, marked II in FIG. 1, of the fuel injection system in an enlarged view.
Figure 3:
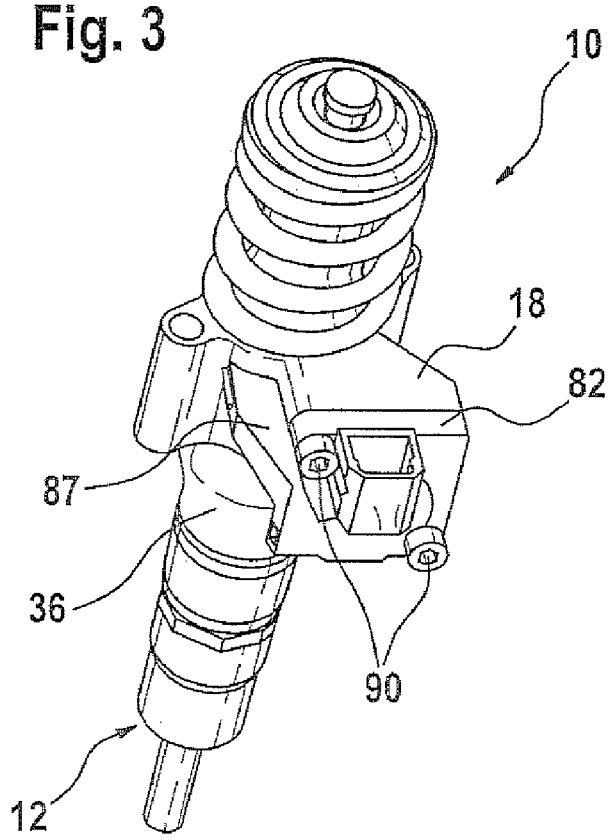
FIG. 3 shows the fuel injection system in fragmentary form, in a view in the direction of the arrow III in FIG. 1.
Figure 4:
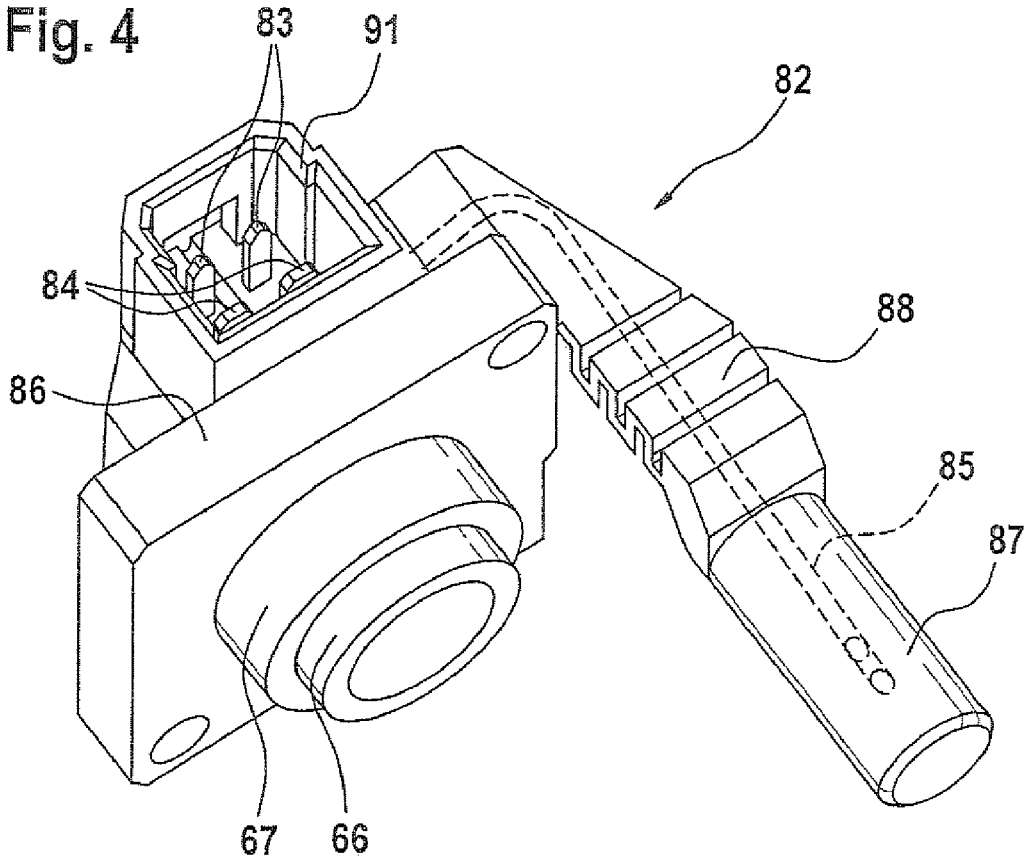
FIG. 4 is an enlarged perspective view of a structural element of the fuel injection system.
Figure 5:
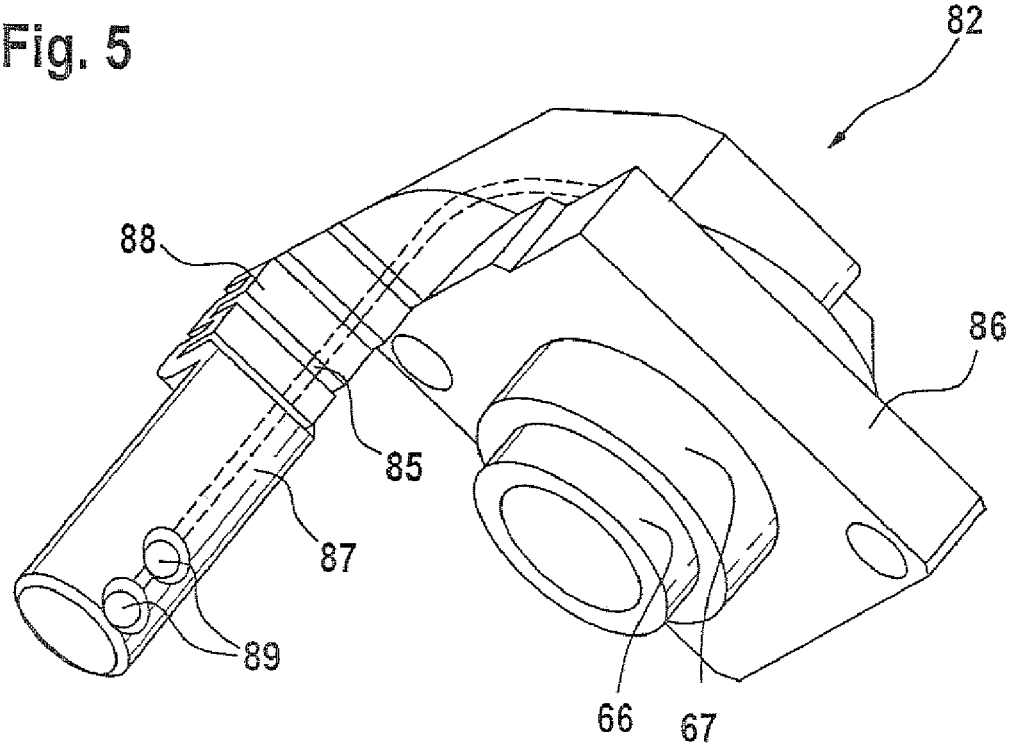
FIG. 5 shows the structural element in a further perspective view.

In FIG. 1, a fuel injection system for an internal combustion engine, for instance of a motor vehicle, is shown schematically. The engine is preferably a self-igniting engine and has one or more cylinders. The fuel injection system may for instance, as shown in FIG. 1, be embodied as a unit fuel injector, which has one high-pressure fuel pump 10 and one fuel injection valve 12 for each cylinder of the engine, and these form a common structural unit. Two electrically actuated control valves 56, 60 for controlling the fuel injection are disposed on the unit fuel injector. The fuel injection system may also be embodied differently, for instance as a pump-line-nozzle unit, in which once again there are one high-pressure fuel pump and one fuel injection valve for each cylinder of the engine, but the pump and the valve are disposed separately from one another and communicate with one another via a hydraulic line. The two control valves for controlling the fuel injection are disposed on the fuel injection valve in the pump-line-nozzle unit.

The invention will be described below in terms of use in a unit fuel injector, but it can be adopted to the aforementioned other versions of fuel injection systems as well. The high-pressure fuel pump 10 has a pump piston 20, which is guided tightly in a cylinder bore 16 of a pump body 18 and which defines a pump work chamber 22 in the cylinder bore 16. The pump piston 20 is driven at least indirectly, for instance via a tilt lever, in a reciprocating motion counter to the force of a restoring spring 26 by a cam 24 of a camshaft of the engine. In the intake stroke of the pump piston 20, fuel from a fuel tank 28 is delivered to the pump work chamber 22, for instance by means of a feed pump 29.

The fuel injection valve 12 has a valve body 30, which is connected to the pump body 18 and may be embodied in multiple pans, and in the valve body, in a bore 32, an injection valve member 34 is guided tightly and longitudinally displaceably. Between the valve body 30 and the pump body 18, an intermediate body 36 may be disposed. The valve body 30, in its end region toward the combustion chamber of the cylinder of the engine, has at least one and preferably a plurality of injection openings 38. In its end region toward the combustion chamber, the injection valve member 34 has a sealing face 40, which for instance is approximately conical and which cooperates with a valve seat 41, embodied in the end region of the valve body 30 toward the combustion chamber, from or downstream of which seat the injection openings 38 lead away. In the valve body 30, between the injection valve member 34 and the bore 32 toward the valve seat 41, there is an annular chamber 42, which in its end region, remote from the valve seat 41, changes over by way of a radial widening of the bore 32 into a pressure chamber 44 that surrounds the injection valve member 34. At the level of the pressure chamber 44, by means of a cross-sectional change, the injection valve member 34 has a pressure shoulder 46 oriented toward the valve seat 41. The end of the injection valve member 34 remote from the combustion chamber is engaged by a prestressed closing spring 48, by which the injection valve member 34 is pressed toward the valve seat 41. The closing spring 48 is disposed in a spring chamber 49 which is located in the valve body 30 or the intermediate body 36 and adjoins the bore 32.

The spring chamber 49 is adjoined, on its end remote from the pressure chamber 44, by a bore 50 of smaller diameter. A control piston 51 is tightly guided in the bore 50 and defines a control pressure chamber 52 in the bore 50. The control piston 51 is braced on the injection valve member 34, but it may also be embodied in one piece with the injection valve member 34, and depending on the pressure prevailing in the control pressure chamber 52, it generates a force in the closing direction on the injection valve member 34 that reinforces the closing spring 48. From the pump work chamber 22, a conduit 54 leads though the pump body 18, the intermediate body 36, and the valve body 30 into the pressure chamber 44 of the fuel injection valve 12. From the conduit 54, a communication 55 leads away to the feed pump 29 and to the fuel tank 28. The communication 55 is controlled by a first electrically actuated control valve 56, which is embodied as a 2/2-way valve. The control valve 56 may be embodied as a magnet valve with an electromagnetic actuator and is controlled by an electric control unit 57 and will be described in further detail hereinafter. From the conduit 54, a further conduit 58 leads away into the control pressure chamber 52, and the control pressure chamber 52 has a communication 59 with a relief region, such as a return line to the fuel tank 28. The communication 59 of the control pressure chamber 52 with the relief region is controlled by a second electrically actuated control valve 60, which is likewise triggered by the control unit 57. The second control valve 60 may likewise be embodied as a magnet valve, with an electromagnetic actuator. Alternatively, the first control valve 56 and/or the second control valve 60 may have a piezoelectric actuator. The pressure buildup in the pump work chamber 22 of the high-pressure fuel pump 10 is controlled by the first control valve 56, and the pressure in the control pressure chamber 52, and as a result, regardless of the pressure buildup in the pump work chamber 22, the opening motion of the injection valve member 34 of the fuel injection valve 12 are controlled by the second control valve 60. If because of the pressure prevailing in the control pressure chamber 52 when the second control valve 60 is closed and the closing spring 48 generates a greater force on the injection valve member 34 in the closing direction than the force generated in the opening direction 35 via the pressure shoulder 46 as a result of the pressure prevailing in the pressure chamber 44, then the injection valve member 34 remains in its closing position or is moved into its closing position. If the pressure prevailing in the pressure chamber 44 exerts a greater force on the injection valve member 34, via the pressure shoulder 46, than the closing spring 48 and the pressure prevailing in the control pressure chamber 52 when the second control valve 60 is open, then the injection valve member 34 moves in the opening direction 35 and uncovers the injection openings 38.

The first control valve 56 has a control valve member 62, by which, in cooperation with a valve seat 63, the communication 55 of the pump work chamber 22 with the relief region is opened in a first position and closed in a second position. The control valve member 62 is displaceable between its two positions by the actuator 64, counter to the force of a restoring spring 65. The control valve member 62 is disposed for instance such that it is guided displaceably transversely, preferably perpendicular to the direction of motion of the injection valve member 34, in a bore 19 in the pump body 18. The actuator 64 embodied as an electromagnet is disposed on the outer circumference of the pump body 18. The actuator 64 has a magnet coil 66, a magnet cup 67, and a magnet armature 68, and the magnet armature 68 acts on the control valve member 62.

The second control valve 60 has a control valve member 72, by which, in cooperation with a valve seat 73, the communication 59 of the control pressure chamber 52 with the relief region is opened in a first position and closed in a second position. The control valve member 72 is displaceable between its two positions by the actuator 74, counter to the force of a restoring spring 75. The control valve member 72 is disposed for instance such that it is displaceable approximately parallel to the direction of motion of the injection valve member 34. The actuator 74 embodied as an electromagnet is disposed in the intermediate body 36 or in the valve body 30 and has a magnet coil 76, a magnet cup 77, and a magnet armature 78, and the magnet armature 78 acts on the control valve member 72. For electrical contacting of the magnet coil 76, at least one electrical terminal 79 on the second control valve 60 is provided, which is embodied for instance as part of a plug-in connection. For instance, three electrical terminals 79 are provided, which are embodied as plug prongs. The plug prongs 79 are for instance disposed approximately parallel to the direction of motion of the control valve member 72.

In the pump body 18, a conduit 80 is provided, which is formed by a bore in the pump body 18 and extends transversely, preferably at least approximately perpendicular to the direction of motion of the injection valve member 34, and discharges on one end on the outer circumference of the pump body 18. Two bores 81 discharge into the conduit 80, near its closed end that is located inside the pump body 18. The bores 81 extend at least approximately perpendicular to the conduit 80 and discharge at the face end of the pump body 18 oriented toward the intermediate body 36.

In the region of the actuator 64 of the first control valve 56, a structural element 82 that can be secured to the pump body 18 is provided, on which electrical terminals 83 for the first control valve 56 and electrical terminals 84 for the second control valve 60 are disposed. The electrical terminals 83, 84 are preferably embodied as plug prongs with which corresponding plug bushes can be joined that are disposed in a plug or in separate plugs disposed in turn on the electric lines leading to the control unit 57. Preferably, only a single plug is provided, with which all the plug terminals 83, 84 are contacted.

At least one electric connecting line 85 leading from the terminals 84 to the second control valve 60 is integrated with the structural element 82. The structural element 82 has a central region 86, secured to the pump body 18, and a finger 87, which protrudes from the central region into the conduit 80 and in which the connecting lines 85 extend. The connecting lines 85 are embodied for instance as conductor tracks or contact tracks. The structural element 82 is preferably of plastic and is produced by injection molding, and the connecting lines 85 are spray-coated with the plastic material. The finger 87 of the structural element 82 is preferably embodied as elastically deformable in at least a portion of its longitudinal extent. Elastic deformability of the finger 87 can be attained for instance by means of a spring-bellows-like portion 88. In the portion 88, the finger 87 is elastically deformable in both the longitudinal direction and the transverse direction. The end region, protruding into the conduit 80, of the finger 87 is embodied cylindrically, and disposed in this end region are electric terminal elements 89, which are open toward the outer jacket of the finger 87 and are preferably embodied as plug bushes. The finger 87 of the structural element 82 can be thrust into the conduit until it contacts a defined stop, and in the end position of the finger 87, the plug bushes 89 are aligned with the bores 81. When the pump body 18 is joined to the intermediate body 36 in the direction of the longitudinal axis 17 of the cylinder bore 16, the plug prongs 79 of the second control valve 60 pass through the bores 81 and enter the plug bushes 89 of the finger 87 of the structural element 82, so that the actuator of the second control valve 60 is electrically contacted with the connecting lines 85. Instead of an elastic deformability of the finger 87 of the structural element 82, it may be provided that the plug prongs 79 of the second control valve 60 and/or the plug bushes 89 of the structural element 82 are elastically deformable, to enable compensating for production tolerances and/or thermal expansions.

The central region 86 of the structural element 82 can be secured to the pump body 18 by means of one or more screws 90, for instance. A plug housing 91 is integrally formed onto the central region 86 of the structural element 82, and the plug prongs 83, 84 are disposed in this housing and with it one or more plugs can be put together with the electric lines that lead to the control unit 57. At least one component of the first control valve 56 is preferably disposed in the central region 86 of the structural element 82. The magnet cup 67 and/or the magnet coil 66 is preferably disposed in the central region 86. By means of the structural element 82, not only is the joint electrical contacting of the two control valves 56, 60 made possible, but also the first control valve 56 is in part formed by it, so that for the first control valve, only a few further individual components are needed, essentially only the magnet armature 68. The magnet cup 67 and/or the magnet coil 66 can be integrated with the structural element 82 in the production of the structural element 82 in an injection mold, or can be joined to the structural element 82 after the production of the structural element 82, for instance by means of press-fitted connections or in some other way. The magnet coil 66 is connected to the plug terminals 83 via connecting elements extending inside the structural element 82.

Upon securing of the structural element 82 to the pump housing 18, the magnet coil 66 and/or the magnet cup 67 disposed on the housing is introduced into a corresponding receptacle on the pump housing 18 that is embodied for instance as a bore 92. Moreover, the finger 87 of the structural element 82 is introduced in the process into the conduit 80, and the bore 92 and the conduit 80 extend at least approximately parallel to one another. In the end position of the structural element 82, its central region 86 comes to rest on the pump housing 18, and its finger 87 comes into contact with its stop, and the bores 81 are aligned with the plug bushes 89 in the finger 87. Because of the elastically deformable portion 88 of the finger 87, compensation for production tolerances is made possible, as is compensation for various thermal expansions. By means of the finger 87, the conduit 80 is sealed off, and at least one elastic sealing ring 93 may additionally be provided between the finger 87 and the conduit 80.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection system for an internal combustion engine, the system comprising at least two electrically actuated control valves for controlling the fuel injection, an electric control unit, electric lines connecting each of the control valves to the electric control unit, terminal elements on the system for connecting the electric lines, a structural element for a first of the control valves the terminal elements for all the control valves disposed on the structural element, means securing the structural element to a housing part of the fuel injection system, and at least one electric connecting line from the terminal elements to the second control valve, is integrated with the structural element and disposed inside a housing part of the fuel injection system.

2. The fuel injection system as defined by claim 1, wherein the first control valve is disposed in a first housing part of the fuel injection system, on which housing part the structural element can be secured; wherein the second control valve is disposed in a second housing part of the fuel injection system; and wherein upon the joining together of the two housing parts, the at least one connecting line integrated with the structural element is contacted with the second control valve.

3. The fuel injection system as defined by claim 2, wherein the first housing part comprises a conduit which discharges on the outside of that housing part; wherein the structural element comprises a finger in which the at least one connecting line extends and which can be introduced into the conduit; and wherein the contacting of the at least one connecting line with the second control valve is effected transversely to the longitudinal extent of the conduit.

4. The fuel injection system as defined by claim 1, wherein at least one part of an electric actuator of the first control valve is disposed on the structural element.

5. The fuel injection system as defined by claim 2, wherein at least one part of an electric actuator of the first control valve is disposed on the structural element.

6. The fuel injection system as defined by claim 3, wherein at least one part of an electric actuator of the first control valve is disposed on the structural element.

7. The fuel injection system as defined by claim 4, further comprising a magnet coil and/or a magnet cup of an electromagnetic actuator of the first control valve disposed on the structural element.

8. The fuel injection system as defined by claim 5, further comprising a magnet coil and/or a magnet cup of an electromagnetic actuator of the first control valve disposed on the structural element.

9. The fuel injection system as defined by claim 6, further comprising a magnet coil and/or a magnet cup of an electromagnetic actuator of the first control valve disposed on the structural element.

10. The fuel injection system as defined by claim 1, wherein at least in the region of the at least one connecting line, the structural element, is embodied as elastically deformable in at least one portion.

11. The fuel injection system as defined by claim 10, wherein the structural element in the portion is embodied as elastically deformable in the longitudinal direction of the at least one connecting line and transversely to the longitudinal direction.

12. The fuel injection system as defined by claim 1, further comprising a plug-in connection effecting the contacting of the at least one connecting line with the second control valve, parts of the plug-in connection being disposed on the second control valve, while other parts of the plug-in connection are disposed on the structural element.

13. The fuel injection system as defined by claim 2, further comprising a plug-in connection effecting the contacting of the at least one connecting line with the second control valve, parts of the plug-in connection being disposed on the second control valve, while other parts of the plug-in connection are disposed on the structural element.

14. The fuel injection system as defined by claim 3, further comprising a plug-in connection effecting the contacting of the at least one connecting line with the second control valve, parts of the plug-in connection being disposed on the second control valve, while other parts of the plug-in connection are disposed on the structural element.

15. The fuel injection system as defined by claim 4, further comprising a plug-in connection effecting the contacting of the at least one connecting line with the second control valve, parts of the plug-in connection being disposed on the second control valve, while other parts of the plug-in connection are disposed on the structural element.

16. The fuel injection system as defined by claim 7, further comprising a plug-in connection effecting the contacting of the at least one connecting line with the second control valve, parts of the plug-in connection being disposed on the second control valve, while other parts of the plug-in connection are disposed on the structural element.

17. The fuel injection system as defined by claim 12, wherein the parts of the plug-in connection that are disposed on the second control valve and/or the parts of the plug-in connection that are disposed on the structural element are embodied as elastically deformable.

18. The fuel injection system as defined by claim 4, wherein the parts of the plug-in connection that are disposed on the second control valve and/or the parts of the plug-in connection that are disposed on the structural element are embodied as elastically deformable.

19. The fuel injection system as defined by claim 5, wherein the parts of the plug-in connection that are disposed on the second control valve and/or the parts of the plug-in connection that are disposed on the structural element are embodied as elastically deformable.

20. The fuel injection system as defined by claim 1, further comprising a high-pressure fuel pump and a fuel injection valve communicating with the high-pressure fuel pump for a cylinder of the engine; and wherein the high-pressure fuel pump has a pump piston, which is driven in a reciprocating motion by the engine and which defines a pump work chamber; wherein by means of one of the control valves, a communication of the pump work chamber with a relief region is controlled; that the fuel injection valve has at least one injection valve member, by which at least one injection opening is controlled; wherein the injection valve member is urged in a closing direction at least indirectly by the pressure prevailing in a control pressure chamber; and wherein the pressure prevailing in the control pressure chamber is controlled by another one of the control valves.

* * * * *